United States Patent [19]

Van Wormer et al.

[11] Patent Number: 4,600,058

[45] Date of Patent: Jul. 15, 1986

[54] EQUIPMENT INSERT AND METHOD

[75] Inventors: Richard A. Van Wormer; John L. Baugh; Charles Ledet, all of Huntsville; Malcolm Roach, Houston, all of Tex.

[73] Assignee: Hughes Tool Company, Houston, Tex.

[21] Appl. No.: 702,964

[22] Filed: Feb. 19, 1985

[51] Int. Cl.[4] ..... E21B 23/06; E21B 33/128

[52] U.S. Cl. ..... 166/382; 166/123; 166/387

[58] Field of Search ..... 166/381, 382, 387, 123, 166/124, 217, 206

[56] References Cited

U.S. PATENT DOCUMENTS 3,631,925 1/1972 Nutter ..... 166/123 X
4,153,109 5/1977 Szescila ..... 166/381 X
4,437,516 3/1984 Cockrell ..... 166/124 X
4,479,548 10/1984 Gilbert ..... 166/123 X

*Primary Examiner*—Stephen J. Novosad
*Assistant Examiner*—David J. Bagnell
*Attorney, Agent, or Firm*—Charles D. Gunter, Jr.

[57] ABSTRACT

An equipment insert is shown for use within a section of well pipe. The equipment insert is installed within the pipe bore at the well surface. The equipment insert is run into the bore of the well pipe and manipulated with a hand tool to actuate gripping slips and a seal ring to grip the pipe interior bore and to form a seal with the interior bore of the section of well pipe. The section of well pipe containing the equipment insert can then be made up in the well pipe string, and the well pipe string can be run into the well bore for conducting well bore operations.

6 Claims, 3 Drawing Figures

EQUIPMENT INSERT AND METHOD

BACKGROUND OF THE INVENTION

1. Field of the Invention

The present invention relates to devices installed within oil and gas well pipe for conducting well bore operations and, specifically, to an equipment insert which is installed within a section of well pipe at the surface and which is then made up into a pipe string and run into the well bore.

2. Description of the Prior Art

In this specification, the term "pipe" will be understood to refer to well pipe, tubing, casing, etc. The term "equipment" will be understood to mean devices of the type used in conducting well bore operations including landing collar inserts, flapper valves, back pressure check valves, ball catching subs, baffle type catcher subs, valve type orifice float collars, orifice float collars, cementing bridge plugs, cementing retainers, cementing set shoes, plugs in flow lines and similar equipment.

In the past, the required well bore equipment was typically provided in a specialized pipe sub which would be made up into the pipe string of the customer. This was problematical, at times, because some customers utilized pipe strings with custom threads which would not match the threads of the specialized pipe sub, or which would require cutting special threads on the specialized sub.

U.S. Pat. No. 4,248,300, entitled "Method of and Apparatus for Positioning Retrievable Landing Nipple in a Well Bore String", issued Feb. 3, 1981, is typical of prior art devices in which a landing collar is run into the well bore on a pipe string and secured within a surrounding well conduit. The landing collar is latched into a specially milled groove in the surrounding conduit. U.S. Pat. No. 4,399,873, entitled "Retrievable Insert Landing Assembly", issued Aug. 23, 1983, shows another landing assembly which is run into the interior bore of a packer and which is engaged to provide a landing shoulder within the packer by latching the device within a groove milled within the bore of the packer. Such prior art devices suffer from the deficiency of requiring special milling of the surrounding conduit or special couplings and threads in the surrounding conduit.

SUMMARY OF THE INVENTION

The present invention has as its object the provision of an equipment insert which can be installed within the cylindrical interior bore of an existing section of well pipe, so that a specialized pipe sub is not required. Another object of the invention is to provide such an equipment insert which does not require special milling of the surrounding pipe bore. Another object of the invention is to provide an equipment insert which can be hand installed at the well surface within any section of pipe having connecting threads which match the threaded connections in the remainder of the pipe string. The section of pipe containing the equipment insert can then be made up in the well pipe string to be inserted into the well bore.

These and other objects are accomplished by providing an equipment insert to be installed into the interior bore of a section of well pipe at the well surface prior to making up the section of pipe into a well pipe string. The well pipe can be of the type having threaded surfaces at the opposite ends thereof for engaging mating threaded surfaces of the adjoining pipes in the well pipe string and can have a standard, cylindrical interior bore. The equipment insert is run into the section of well pipe at the well surface. Gripping means are provided on the exterior of the equipment insert for gripping the cylindrical interior bore of the section of the well pipe and sealing means are provided on the exterior of the equipment insert for forming a seal between the exterior of the equipment insert and the cylindrical interior bore of the section of well pipe. The equipment insert is then manipulated at the well surface to actuate the gripping means and sealing means to grip the pipe interior and to form a seal with the cylindrical interior bore of the section of well pipe. The section of well pipe containing the equipment insert, and having threaded ends which mate with the remainder of the pipe string, can then be made up into the well pipe string and run into the well bore for conducting well bore operations.

Additional objects, features and advantages will be apparent in the written description which follows.

DETAILED DESCRIPTION OF THE INVENTION

Figure 1:
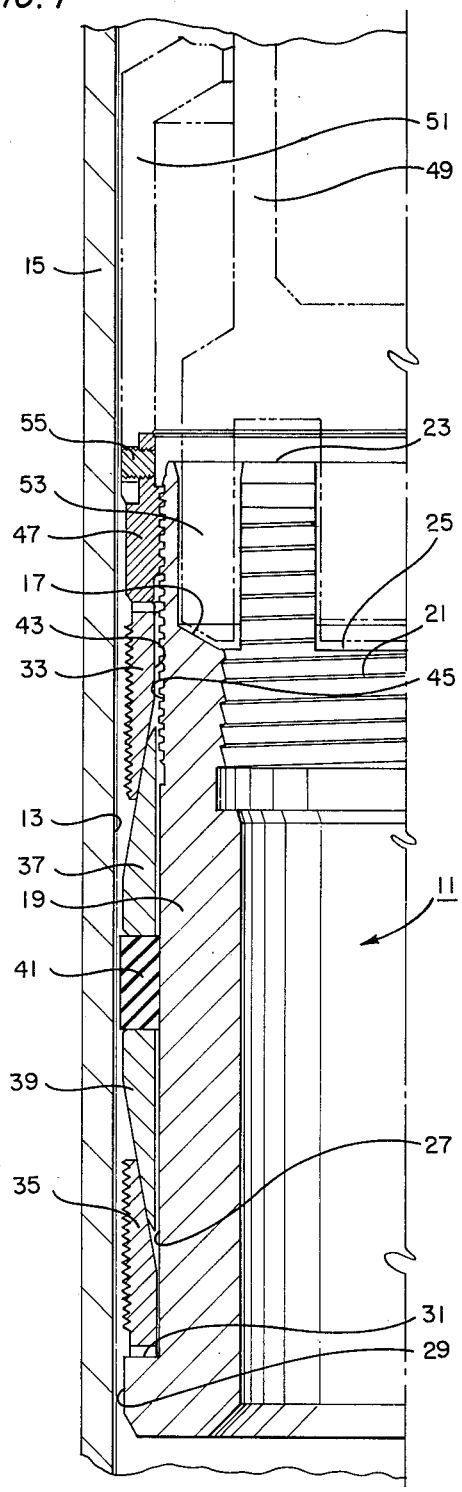
FIG. 1 is a partial, cross-sectional view of a section of well pipe with the equipment insert of the invention inserted into the interior bore thereof and with an insert setting tool shown in dotted lines.
Figure 3:
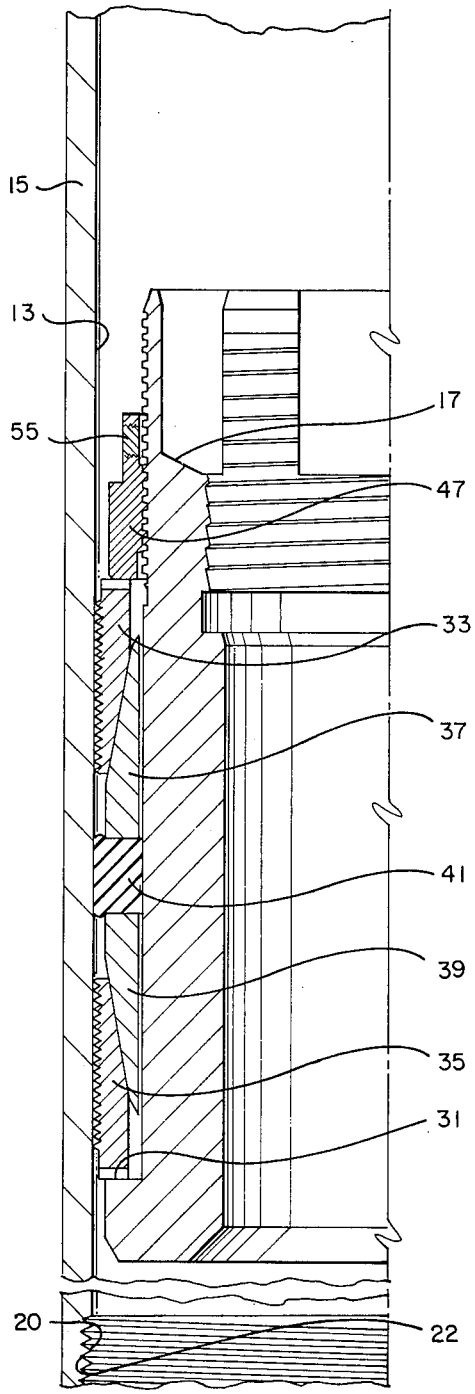
FIG. 3 is a cross-sectional view of the equipment insert after removal of the setting tool.

Turning to FIG. 1, there is shown an equipment insert of the invention designated generally as 11. The equipment insert 11 is adapted to be installed within the interior bore 13 of a section of well pipe 15 at the well surface prior to making up the section of well pipe 15 into a well pipe string (not shown) which is subsequently run into the well bore. As shown in FIG. 3, the well pipe 15 has threaded surfaces 20 at the opposite ends thereof for engaging mating threaded surfaces 22 of the adjoining pipes in the well pipe string. The section of well pipe 15 could be, e. g., a pipe sub adapted to be made up above the cementing shoe in a well cementing pipe string. As will be explained, the internal profile 17 contained within the tubular body 19 of the equipment insert 11 could then be used to catch a liner wiper plug dropped down the pipe string.

Although reference has been made to a landing collar for catching a liner wiper or other plug, it should be understood that the present device and method can be utilized with any type of well bore "equipment", including float collars, flapper valves, check valves, bridge plugs, retainers and the like.

The equipment insert tubular body 19, shown in FIG. 1, has a threaded interior surface 21 at the upper end 23. The interior bore is provided with four identical and equidistantly spaced scallops 25 which are arranged 90° apart in circumferential fashion.

The exterior surface 27 of the tubular body 19 has a raised external region 29 which forms a shoulder 31 for retaining a slip and cone arrangement. The slip and cone arrangement includes upper and lower axially spaced gripping slips 33, 35 which are initially spaced apart by upper and lower cones 37, 39, and an intermediate elastomeric seal ring 41. The cones 37, 39 are preferably solid metal rings, and the slips 33, 35 are preferably solid metallic rings which are split at one circumferential location.

The upper slip 33 has a lower surface 43 which initially is positioned above a threaded exterior surface 45 of the tubular body 19. Immediately above the upper slip 33, an internally threaded setting ring 47 is engaged upon the outer extent of the tubular body threaded surface 45.

Figure 2:
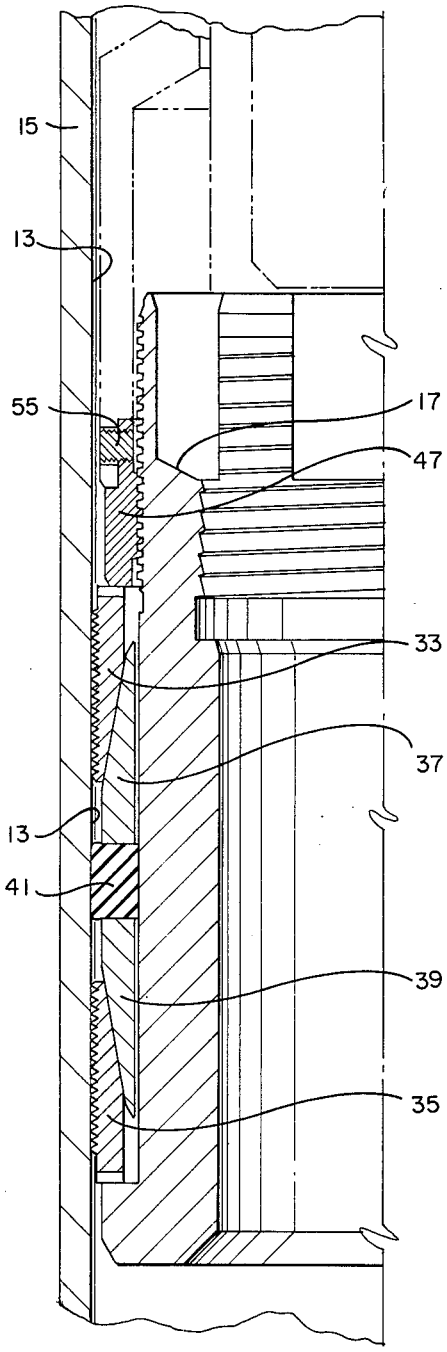
FIG.2 is a cross-sectional view similar to FIG. 1, showing the equipment insert in the set position.

A setting means, shown in dotted lines in FIGS. 1–2, is used to run the equipment insert 11 into the section of pipe 15 at the well surface. The setting means can be any tool capable of producing opposite relative rotational movement between the setting ring 47 and the tubular body 19. For instance, the setting tool can comprise inner and outer cylindrical members 49, 51. The inner cylindrical member 49 can be provided with fingers or prongs 53 adapted to be received within the internal scallops 25 of the tubular body 19. The outer cylindrical member 51 can be shearably connected to the setting ring 47 by means of a plurality of shear pins 55.

The operation of the equipment insert will now be described. FIG. 1 shows the running-in position of the device. At the well surface, the user runs the equipment insert 11 into position within the pipe sub 15 by inserting the insert into the interior bore 13 of the pipe with the setting tool. Once the equipment insert 11 is positioned at the desired location, the user rotates the outer cylindrical member 51 relative to the inner member 49, thereby causing the setting ring 47 to travel down the threaded exterior surface 45 of the tubular body 19. As the setting ring 47 moves downwardly on the threaded surface 45, the slips 33, 35 are moved radially outwardly due to contact with the cones 37, 39 to grip the surrounding bore 13 of the well pipe 15. As shown in FIG. 2, the movement of the slips and cones also results in a compressive force being applied to the seal ring 41, causing the seal ring to sealingly engage the interior bore 13 of the pipe 15.

The shear pins 55 are selected to have a predetermined shear point which exceeds the force required to set the slips and compress the seal ring 41. Continued torque applied to the setting tool results in a shearing load being applied to the shear pins 55, thereby releasing the setting tool for removal from the well pipe. FIG. 3 shows the equipment insert 11 in the set position within the bore 13 and with the setting tool removed. The section of well pipe 15 is then made up into the well pipe string at the rig floor and the well pipe string is lowered into the well bore for conducting well bore operations.

An invention has been provided with several advantages. The equipment insert of the invention does not require a specially milled or designed pipe sub or the presence of premium or specially cut threads. The equipment insert can be removed from the pipe string after completion of well bore operations, as by drilling out the insert. Since the gripping and sealing means of the invention are effective to install the equipment insert within any uniformly cylindrical pipe bore, a savings in inventory of insert devices can be realized by the user.

While the invention has been shown in only one of its forms, it is not thus limited but is susceptible to various changes and modifications without departing from the spirit thereof.

We claim:

1. A method of installing an equipment insert into the interior bore of a section of well pipe at the well surface prior to making up the section of pipe into a well pipe string, the well pipe being of the type having threaded surfaces at the opposite ends thereof for engaging mating threaded surfaces of the adjoining pipes in the well pipe string and having a cylindrical interior bore, comprising the steps of:

running an equipment insert into the section of well pipe at the well surface, the equipment insert being connected to a hand operated setting tool;

providing gripping means on the exterior of the equipment insert for gripping the cylindrical interior bore of the section of well pipe and providing sealing means on the exterior of the equipment insert for forming a seal between the exterior of the equipment insert and the cylindrical interior bore of the section of well pipe;

manipulating the hand operated setting tool at the well surface to actuate the gripping means and sealing means to grip the pipe interior bore and to form a seal with the interior bore of the section of well pipe;

making up the section of well pipe containing the equipment insert into the well pipe string; and running the well pipe string into the well bore and conducting well bore operations.

2. A method of installing an equipment insert into the interior bore of a section of well pipe at the well surface prior to making up the section of pipe into a well pipe string, the well pipe being of the type having threaded surfaces at the opposite ends thereof for engaging mating threaded surfaces of the adjoining pipes in the well pipe string and having a cylindrical interior bore, comprising the steps of:

running an equipment insert into the section of well pipe at the well surface, the equipment insert being connected to a hand operated setting tool by a shearable connection;

providing gripping means on the exterior of the equipment insert for gripping the cylindrical interior bore of the section of well pipe and providing sealing means on the exterior of the equipment insert for forming a seal between the exterior of the equipment insert and the cylindrical interior bore of the section of well pipe;

manipulating the hand operated setting tool at the well surface to actuate the gripping means and sealing means of the equipment insert to grip the pipe interior bore and to form a seal with the interior bore of the section of well pipe;

continuing to manipulate the setting tool to shear the shearable connection;

removing the setting tool;

making up the section of well pipe containing the equipment insert into the well pipe string; and running the well pipe string into the well bore and conducting well bore operations.

3. The method of claim 2, wherein said setting tool is manipulated by rotating said setting tool relative to said equipment insert.

4. The method of claim 3, wherein said shearable connection is sheared by further rotating said setting tool relative to said equipment insert.

5. A method of installing an equipment insert into the interior bore of a section of well pipe at the well surface prior to making up the section of pipe into a well pipe string, the well pipe being of the type having threaded surfaces at the opposite ends thereof for engaging mating threaded surfaces of the adjoining pipes in the well pipe string and having a cylindrical interior bore, comprising the steps of:

running an equipment insert into the section of well pipe at the well surface, the equipment insert being connected to a hand-operated setting tool by a shearable connection;

providing axially spaced gripping slips on the exterior of the equipment insert for gripping the cylindrical interior bore of the section of well pipe and providing a seal ring intermediate the gripping slips on the exterior of the equipment insert for forming a seal between the exterior of the equipment insert and the cylindrical interior bore of the section of well pipe;

engaging an internally threaded setting ring on a mating externally threaded surface of the equipment insert, the gripping slips and seal ring being actuable by rotational movement of the setting ring to grip and seal against the interior bore;

rotating the setting tool by hand at the well surface to actuate the gripping means and sealing means of the equipment insert to grip the pipe interior bore and to form a seal with the interior bore of the section of well pipe;

continuing to manipulate the setting tool to shear the shearable connection;

removing the setting tool;

making up the section of well pipe containing the equipment insert into the well pipe string; and running the well pipe string into the well bore and conducting well bore operations.

6. The method of claim 5, wherein the hand operated setting tool is manipulated to rotate the setting ring while holding the remainder of the equipment insert stationary.

* * * * *